US010987925B2

(12) United States Patent
Fukuda

(10) Patent No.: US 10,987,925 B2
(45) Date of Patent: Apr. 27, 2021

(54) LIQUID EJECTING APPARATUS AND METHOD FOR DRIVING LIQUID EJECTING HEAD

(71) Applicant: SEIKO EPSON CORPORATION, Tokyo (JP)

(72) Inventor: Shunya Fukuda, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 2 days.

(21) Appl. No.: 16/546,740

(22) Filed: Aug. 21, 2019

(65) Prior Publication Data

US 2020/0061990 A1 Feb. 27, 2020

(30) Foreign Application Priority Data

Aug. 23, 2018 (JP) ..... JP2018-156056

(51) Int. Cl.
*B41J 2/045* (2006.01)
*B41J 2/14* (2006.01)

(52) U.S. Cl.
CPC ..... *B41J 2/04588* (2013.01); *B41J 2/04581* (2013.01); *B41J 2/14233* (2013.01)

(58) Field of Classification Search
CPC ..... B41J 2/04588; B41J 2/14233; B41J 2/04581; B41J 2002/14419; B41J 2/04563
See application file for complete search history.

(56) References Cited

U.S. PATENT DOCUMENTS

2004/0227782 A1* 11/2004 Shinkawa ..... B41J 2/04578 347/19

FOREIGN PATENT DOCUMENTS

JP 2000-296610 10/2000

* cited by examiner

*Primary Examiner* — Bradley W Thies
(74) *Attorney, Agent, or Firm* — Workman Nydegger

(57) ABSTRACT

A first drive waveform includes, in the following order: a first section in which voltage is changed, a second section in which the voltage is maintained, and a third section in which the voltage is changed in a direction opposite to another direction in which the voltage is changed in the first section. A second drive waveform includes, in the following order: a fourth section in which voltage is changed, a fifth section in which the voltage is maintained, and a sixth section in which the voltage is changed in a direction opposite to another direction in which the voltage is changed in the fourth section. The voltage applied to a piezoelectric element in the second section is higher than the voltage applied to the piezoelectric element in the fifth section. The period of the first drive waveform is shorter than the period of the second drive waveform.

5 Claims, 11 Drawing Sheets

LIQUID EJECTING APPARATUS AND METHOD FOR DRIVING LIQUID EJECTING HEAD

The present application is based on, and claims priority from JP Application Serial Number 2018-156056, filed Aug. 23, 2018, the disclosure of which is hereby incorporated by reference herein in its entirety.

BACKGROUND

1. Technical Field

The present disclosure relates to a liquid ejecting apparatus configured to eject liquid such as ink.

2. Related Art

A liquid ejecting head has been introduced in which liquid is ejected from a nozzle by applying, by using a piezoelectric element, pressure to a pressure chamber filled with the liquid. For example, JP-A-2000-296610 discloses a method in which the period of a drive waveform applied to a piezoelectric element is determined as a period corresponding to the natural vibration period of a pressure chamber.

Concerning a piezoelectric thin film element, the compliance varies depending on the voltage applied to the piezoelectric element, and thus, the natural vibration period of the pressure chamber also varies depending on the applied voltage. Hence, in the configuration in which the period of the drive waveform is determined as a given fixed period, the relationship between the period of the drive waveform and the natural vibration period varies depending on the voltage applied to the piezoelectric element; in other words, the relationship between the phase of change in pressure occurring in the pressure chamber and the phase of the drive waveform varies depending on the voltage applied to the piezoelectric element. As a result, there is a problem in which an error occurs in an ejection characteristic, such as the amount of ink for ejection or the speed of ejection.

SUMMARY

To address the problem described above, an aspect of the present disclosure provides a liquid ejecting apparatus includes a vibrating plate constituting a wall of a pressure chamber communicating with a nozzle configured to eject liquid, a piezoelectric element that is a thin film element and vibrates the vibrating plate, and a drive circuit that supplies multiple drive waveforms including a first drive waveform and a second drive waveform to the piezoelectric element. The first drive waveform includes, in the following order: a first section in which voltage is changed, a second section in which the voltage is maintained, and a third section in which the voltage is changed in a direction opposite to another direction in which the voltage is changed in the first section. The second drive waveform includes, in the following order: a fourth section in which voltage is changed, a fifth section in which the voltage is maintained, and a sixth section in which the voltage is changed in a direction opposite to another direction in which the voltage is changed in the fourth section. The voltage applied to the piezoelectric element in the second section is higher than the voltage applied to the piezoelectric element in the fifth section. The period of the first drive waveform is shorter than the period of the second drive waveform.

Another aspect of the present disclosure provides a method for driving a liquid ejecting head including a vibrating plate constituting a wall of a pressure chamber communicating with a nozzle configured to eject liquid and a piezoelectric element that is a thin film element and vibrates the vibrating plate. The method includes a first step of supplying a first drive waveform to the piezoelectric element and a second step of supplying a second drive waveform to the piezoelectric element. The first drive waveform includes, in the following order: a first section in which voltage is changed, a second section in which the voltage is maintained, and a third section in which the voltage is changed in a direction opposite to another direction in which the voltage is changed in the first section. The second drive waveform includes, in the following order: a fourth section in which the voltage is changed, a fifth section in which the voltage is maintained, and a sixth section in which the voltage is changed in a direction opposite to another direction in which the voltage is changed in the fourth section. The voltage applied to the piezoelectric element in the second section is higher than the voltage applied to the piezoelectric element in the fifth section. The period of the first drive waveform is shorter than the period of the second drive waveform.

DESCRIPTION OF EXEMPLARY EMBODIMENTS

First Embodiment

Figure 1:
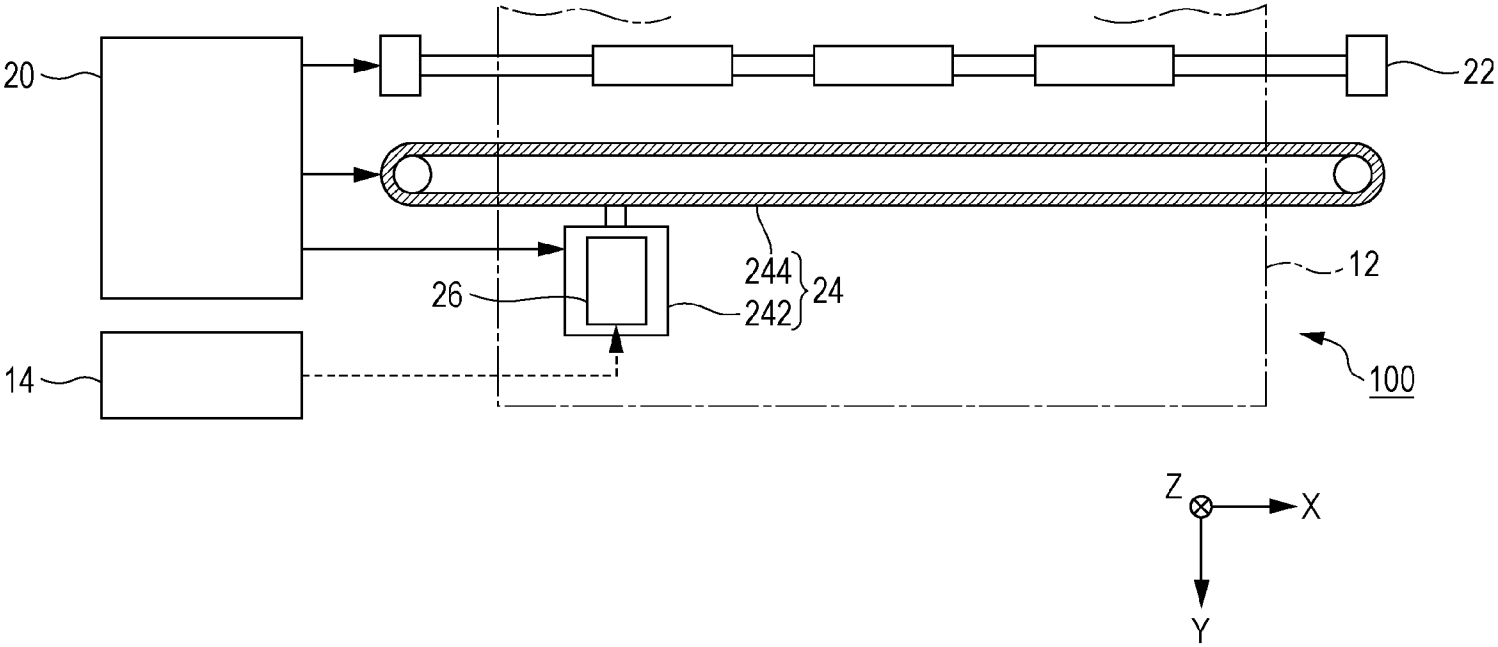
FIG. 1 illustrates a configuration of a liquid ejecting apparatus according to a first embodiment.

FIG. 1 illustrates a configuration of a liquid ejecting apparatus 100 according to a first embodiment of the present disclosure. The liquid ejecting apparatus 100 according to the first embodiment is an ink jet printing apparatus configured to eject ink, which exemplifies liquid, onto a medium 12. While the medium 12 is typically a sheet of printing paper, a printing object made from any material, such as a resin film or a cloth, may also be used as the medium 12. As illustrated in FIG. 1, a liquid container 14 that stores ink is installed in the liquid ejecting apparatus 100. For example, a cartridge capable of being attached to the liquid ejecting apparatus 100 in a detachable manner, a bag-type ink pack made from a flexible film, or an ink tank capable of being refilled with ink may be used as the liquid container 14.

As illustrated in FIG. 1, the liquid ejecting apparatus 100 includes a controller 20, a transporting mechanism 22, a moving mechanism 24, and a liquid ejecting head 26. The controller 20 includes, for example, a processing circuit, such as a central processing unit (CPU) or a field programmable gate array (FPGA), and a storage circuit, such as a semiconductor memory, and controls components of the liquid ejecting apparatus 100 in an overall manner. The transporting mechanism 22 transports the medium 12 in the Y direction under the control of the controller 20.

The moving mechanism 24 causes the liquid ejecting head 26 to reciprocate along the X axis under the control of the controller 20. The X direction of the X axis is intersected by the Y direction, in which the medium 12 is transported. Specifically, the X direction is perpendicular to the Y direction. The moving mechanism 24 according to the first embodiment includes a carriage 242 that is substantially box-shaped and accommodates the liquid ejecting head 26 and a transport belt 244 to which the carriage 242 is affixed. It should be noted that the configuration in which multiple liquid ejecting heads 26 are installed in the carriage 242 or the configuration in which the liquid container 14 is installed together with the liquid ejecting head 26 in the carriage 242 may also be applied.

The liquid ejecting head 26 ejects, from multiple nozzles N, ink supplied from the liquid container 14 onto the medium 12 under the control of the controller 20. While the transporting mechanism 22 transports the medium 12 and the carriage 242 reciprocates repeatedly, the liquid ejecting head 26 ejects ink onto the medium 12, and as a result, a desired image is formed on the surface of the medium 12.

Figure 2:
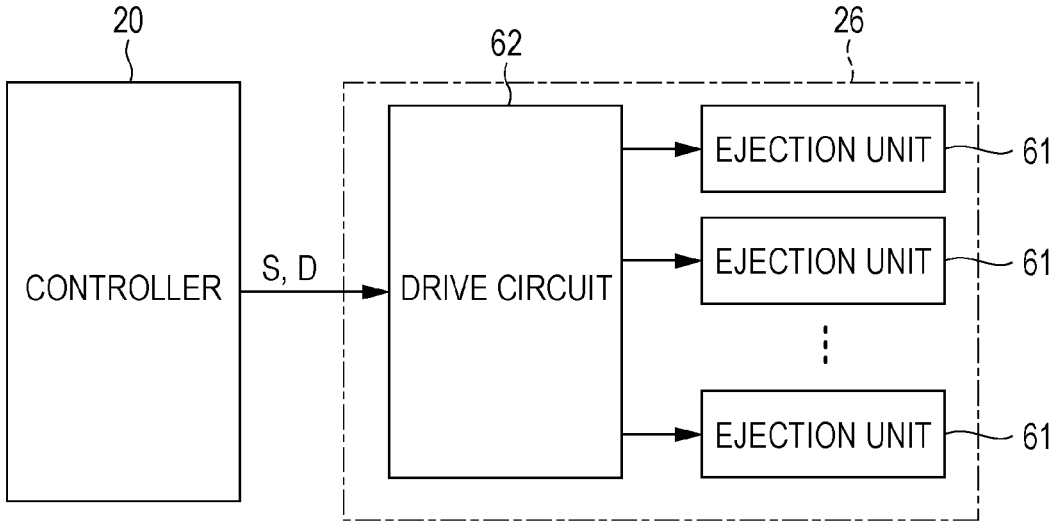
FIG. 2 is a block diagram illustrating an example of a functional configuration of the liquid ejecting apparatus.

FIG. 2 is a block diagram focusing on the functional configuration of the liquid ejecting apparatus 100. The illustration of the transporting mechanism 22 and the moving mechanism 24 is omitted for convenience of illustration. As illustrated in FIG. 2, the controller 20 according to the first embodiment supplies a control signal S and a drive signal D to the liquid ejecting head 26. The control signal S is used to instruct each of the multiple nozzles N whether ink is to be ejected from the particular nozzle and the amount of ink for ejection from the particular nozzle. The drive signal D is a voltage signal that changes at predetermined intervals.

As illustrated in FIG. 2, the liquid ejecting head 26 according to the first embodiment includes multiple ejection units 61 corresponding to the respective nozzles N and a drive circuit 62 that drives the multiple ejection units 61. The multiple ejection units 61 individually eject ink in accordance with the drive waveform supplied by the drive circuit 62. It should be noted that the drive circuit 62 may be installed outside the liquid ejecting head 26.

Figure 3:
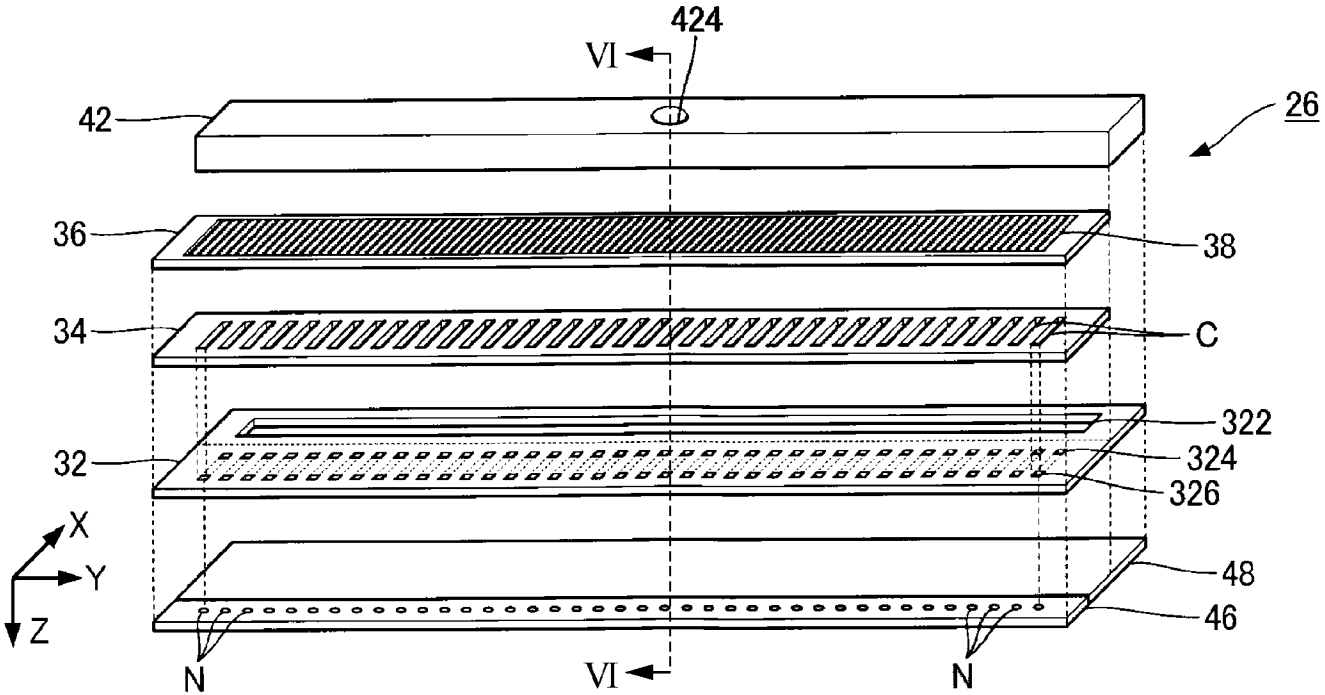
FIG. 3 is an exploded perspective view of the liquid ejecting head.
Figure 4:
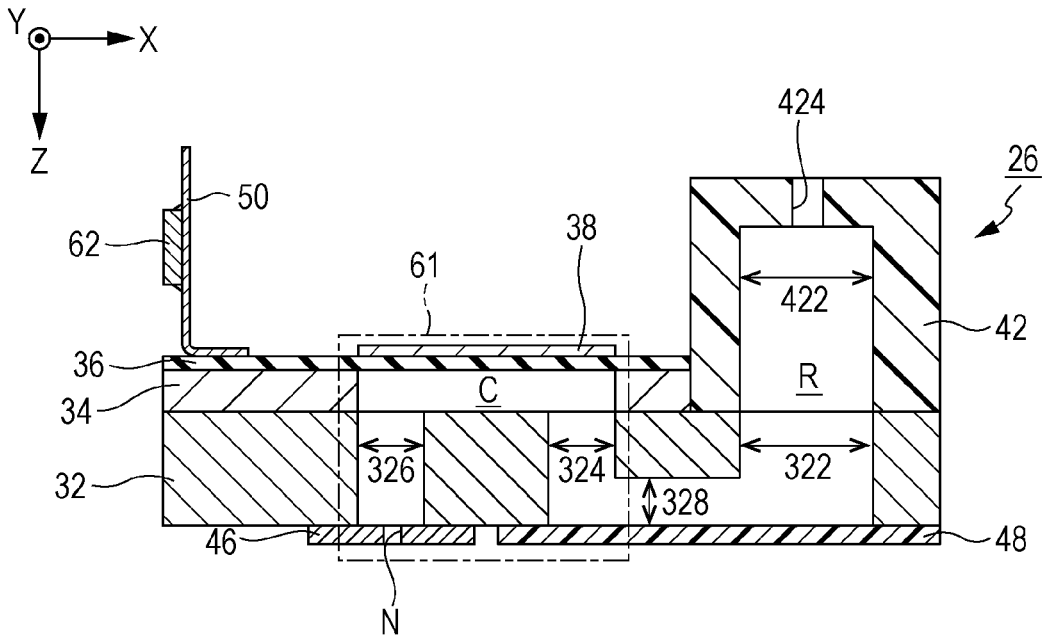
FIG. 4 is a sectional view of the liquid ejecting head.

FIG. 3 is an exploded perspective view of the liquid ejecting head 26. FIG. 4 is a sectional view taken along line IV-IV in FIG. 3. As illustrated in FIGS. 3 and 4, the direction perpendicular to the X-Y plane is hereinafter referred to as the Z direction. The direction in which all the liquid ejecting heads 26 eject ink correspond to the Z direction. The X-Y plane is, for example, a plane parallel to a surface of the medium 12.

As illustrated in FIGS. 3 and 4, the liquid ejecting head 26 includes a flow channel substrate 32 in a substantially rectangular shape elongated in the Y direction. A pressure chamber substrate 34, a vibrating plate 36, multiple piezoelectric elements 38, and a housing 42 are disposed on the upstream surface of the flow channel substrate 32 in the Z direction. A nozzle plate 46 and a vibration absorber 48 are disposed on the downstream surface of the flow channel substrate 32 in the Z direction. The components of the liquid ejecting head 26 are substantially plate members elongated in the Y direction similarly to the flow channel substrate 32 and affixed to each other by using, for example, an adhesive.

As illustrated in FIG. 3, the nozzle plate 46 is a plate member in which the multiple nozzles N are formed as an array in the Y direction. The nozzles N are through-holes through which ink passes. The flow channel substrate 32, the pressure chamber substrate 34, the nozzle plate 46 are each formed by, for example, processing a single crystal silicon (Si) substrate by employing a semiconductor manufacturing technology, such as etching. Any material and any manufacturing technology can be used for producing the components of the liquid ejecting head 26. The Y direction may also be referred to as a direction in which the multiple nozzles N are arrayed.

The flow channel substrate 32 is a plate member in which ink flow channels are formed. As illustrated in FIGS. 3 and 4, a cavity 322, supply flow channels 324, and communicating flow channels 326 are formed in the flow channel substrate 32. The cavity 322 is a through-hole elongated in the Y direction in plan view from the Z direction to extend across all the multiple nozzles N. The supply flow channels 324 and the communicating flow channels 326 are through-holes formed to correspond individually to the respective nozzles N. As illustrated in FIG. 4, a junction flow channel 328 is formed on the downstream surface side of the flow channel substrate 32 in the Z direction to extend across all the multiple supply flow channels 324. The junction flow channel 328 communicates the cavity 322 to the multiple supply flow channels 324.

The housing 42 is a structure made by, for example, injection molding using a resin material and affixed to the upstream surface of the flow channel substrate 32 in the Z direction. As illustrated in FIG. 4, a receptacle 422 and an inlet 424 are formed in the housing 42. The receptacle 422 is a recessed portion whose outer periphery forms a shape corresponding to the cavity 322 in the flow channel substrate 32. The inlet 424 is a through-hole communicating with the receptacle 422. As understood from FIG. 4, the space defined by communicating the cavity 322 in the flow channel substrate 32 and the receptacle 422 in the housing 42 to each other functions as a liquid reservoir R. Ink is supplied from the liquid container 14, passed through the inlet 424, and consequently stored in the liquid reservoir R. The vibration absorber 48 is a flexible film forming a wall of the liquid reservoir R and absorbs the change in pressure on ink in the liquid reservoir R.

As illustrated in FIGS. 3 and 4, the pressure chamber substrate 34 is a plate member in which multiple pressure chambers C are formed to correspond to the respective nozzles N. The multiple pressure chambers C are arrayed in the Y direction. The pressure chambers C are cavity portions each elongated in the X direction in plan view. The downstream end of each of the pressure chambers C in the X direction is positioned on a particular one of the supply flow channels 324 in the flow channel substrate 32 in plan view. In contrast, the upstream end of each of the pressure chambers C in the X direction is positioned on a particular one of the communicating flow channels 326 in the flow channel substrate 32 in plan view.

The vibrating plate 36 is mounted on one surface of the pressure chamber substrate 34, the one surface being opposite to the flow channel substrate 32. The vibrating plate 36 is a plate member capable of being changed elastically in shape. The pressure chamber substrate 34 and part or all of the vibrating plate 36 may be formed as one object by selectively removing, from particular areas of a plate member of a given thickness that correspond to the respective pressure chambers C, portions each extending in the direction of the plate thickness.

As understood from FIG. 4, the flow channel substrate 32 and the vibrating plate 36 faces each other while spaced apart from each other inside areas of the pressure chambers C. The pressure chambers C are spaces that are located between the flow channel substrate 32 and the vibrating plate 36 and used to apply pressure to ink introduced in the pressure chambers C. The ink stored in the liquid reservoir R is caused to flow through the junction flow channel 328, routed separately to the supply flow channels 324, and consequently supplied to and introduced in the multiple pressure chambers C in parallel. As understood from the above description, the vibrating plate 36 constitutes a wall of each of the pressure chambers C.

As illustrated in FIGS. 3 and 4, the multiple piezoelectric elements 38 corresponding to the respective nozzles N are disposed on the surface of the vibrating plate 36 opposite to the pressure chambers C. The piezoelectric elements 38 are actuators that vibrate the vibrating plate 36 and each formed in a shape elongated in the X direction in plan view. The multiple piezoelectric elements 38 are arrayed in the Y direction to correspond to the respective pressure chambers C.

Figure 5:
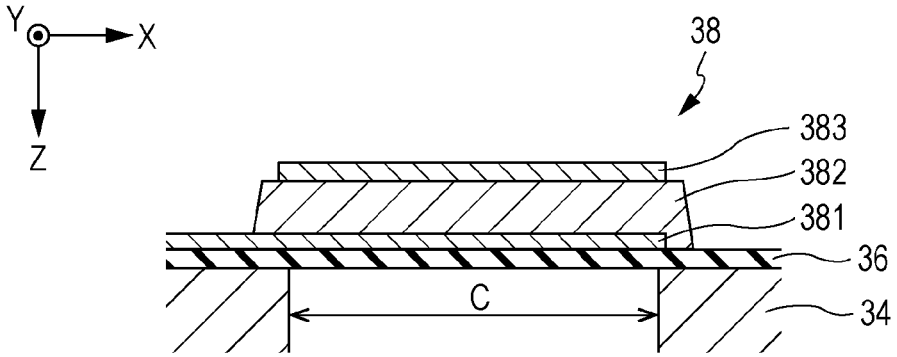
FIG. 5 is a sectional view of a piezoelectric element.

FIG. 5 is a sectional view of any one of the piezoelectric elements 38. As illustrated in FIG. 5, the piezoelectric element 38 is a piezoelectric thin film element formed by stacking a first electrode 381, a piezoelectric layer 382, and a second electrode 383. The first electrode 381 is an individual electrode formed on the surface of the vibrating plate 36 such that the first electrodes 381 of the respective piezoelectric elements 38 are spaced apart from each other. A drive waveform output from the drive circuit 62 is supplied to the first electrode 381. The piezoelectric layer 382 is formed on the surface of the first electrode 381 by using a ferroelectric piezoelectric material, such as PZT. The second electrode 383 is formed on the surface of the piezoelectric layer 382. The second electrode 383 according to the first embodiment is a common electrode strip extending across the multiple piezoelectric elements 38. A given voltage Vbs is applied to the second electrode 383.

When the vibrating plate 36 vibrates under the influence of the piezoelectric element 38 being displaced, the level of the pressure inside the pressure chamber C accordingly changes, and as a result, the ink introduced in the pressure chamber C is passed through the communicating flow channel 326 and the nozzle N and consequently ejected. The ejection units 61 illustrated in FIG. 2 is each a section including the piezoelectric element 38, the vibrating plate 36, and the flow channel from the pressure chamber C to the nozzle N as illustrated in FIG. 4.

As illustrated in FIG. 4, for example, a wiring substrate 50 is joined to the surface of the vibrating plate 36. The wiring substrate 50 is a component including multiple wirings used to electrically couple the controller 20 and the liquid ejecting head 26 to each other. The drive circuit 62 illustrated in FIG. 2 is, for example, an integrated circuit (IC) chip and mount on the wiring substrate 50. For example, a flexible wiring substrate, such as a flexible printed circuit (FPC) or a flexible flat cable (FFC), is applied as the wiring substrate 50 as appropriate.

Figure 6:
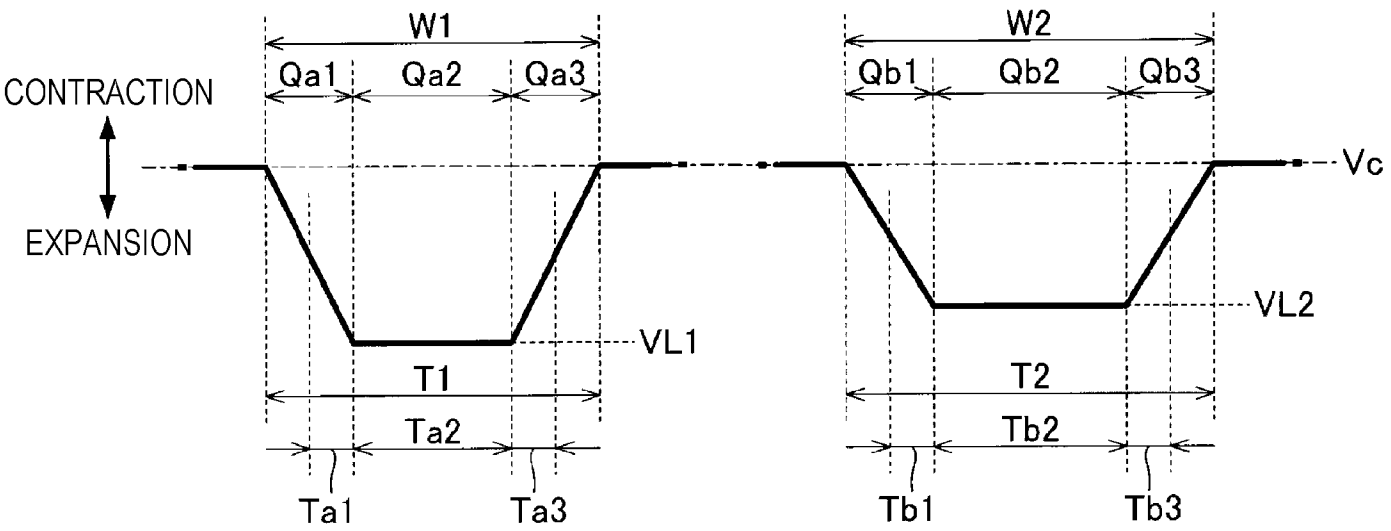
FIG. 6 illustrates drive waveforms.

FIG. 6 is an explanatory diagram illustrating a signal supplied by the drive circuit 62 to each of the piezoelectric elements 38. The drive signal D supplied by the controller 20 to the drive circuit 62 is a voltage signal having a first drive waveform W1 as one period and a second drive waveform W2 as one period that are illustrated in FIG. 6. The drive circuit 62 supplies, to particular ones of the piezoelectric elements 38 that are instructed by using the control signal S to eject ink, one of the first drive waveform W1 and the second drive waveform W2 that is selected in accordance with the control signal S. The first drive waveform W1 indicates a signal used to cause the first amount of ink for ejection to be ejected from the nozzle N. The second drive waveform W2 indicates a signal used to cause the second amount of ink for ejection to be ejected from the nozzle N, in which the second amount of ink for ejection is more than the first amount of ink for ejection.

The drive circuit 62 supplies a given standard value Vc of voltage to other particular ones of the piezoelectric elements 38 that are instructed by using the control signal S to not eject ink. The standard value Vc is a given voltage value identical to or different from the value of the voltage Vbs applied to the second electrode 383. The voltage of the first drive waveform W1 and the voltage of the second drive waveform W2 varies relative to the standard value Vc as time elapses.

As illustrated in FIG. 6, as the voltage supplied by the drive circuit 62 decreases, the piezoelectric element 38 is displaced to increase the volume of the pressure chambers C; and conversely, as the voltage supplied by the drive circuit 62 increases, the piezoelectric element 38 is displaced to decrease the volume of the pressure chambers C. In other words, as the voltage of the first electrode 381 of the piezoelectric element 38 decreases, the pressure inside the pressure chamber C decreases; and as the voltage of the first electrode 381 of the piezoelectric element 38 increases, the pressure inside the pressure chamber C increases.

As illustrated in FIG. 6, the first drive waveform W1 includes a section Qa1, a section Qa2, and a section Qa3 in this order to cover from its start point to its end point. In the section Qa1, the voltage decreases from the standard value Vc to a voltage value VL1, which is lower than the standard value Vc, as time elapses. Accordingly, by supplying the voltage in the section Qa1, the piezoelectric element 38 causes the pressure chamber C to expand. In the section Qa2, the voltage is maintained at the voltage value VL1. In the section Qa3, the voltage increases from the voltage value VL1 to the standard value Vc as time elapses. That is to say, the voltage changes in the opposing directions in the sections Qa1 and Qa3. Accordingly, by supplying the voltage in the section Qa3, the piezoelectric element 38 causes the pressure chamber C to contract. The section Qa1 exemplifies a first section, the section Qa2 exemplifies a second section, and the section Qa3 exemplifies a third section.

As illustrated in FIG. 6, the second drive waveform W2 includes a section Qb1, a section Qb2, and a section Qb3 in this order to cover from its start point to its end point. In the section Qb1, the voltage decreases from the standard value Vc to a voltage value VL2, which is lower than the standard value Vc, as time elapses. Accordingly, by supplying the voltage in the section Qb1, the piezoelectric element 38 causes the pressure chamber C to expand. In the section Qb2, the voltage is maintained at the voltage value VL2. In the section Qb3, the voltage increases from the voltage value VL2 to the standard value Vc as time elapses. That is to say, the voltage changes in the opposing directions in the sections Qb1 and Qb3. Accordingly, by supplying the voltage in the section Qb3, the piezoelectric element 38 causes the pressure chamber C to contract. The section Qb1 exemplifies a fourth section, the section Qb2 exemplifies a fifth section, and the section Qb3 exemplifies a sixth section.

The voltage value VL1 in the section Qa2 of the first drive waveform W1 is smaller than the voltage value VL2 in the section Qb2 of the second drive waveform W2. Thus, the voltage applied across the electrodes of the piezoelectric element 38 in the section Qa2 of the first drive waveform W1 is higher than the voltage applied across the electrodes of the piezoelectric element 38 in the section Qb2 of the second drive waveform W2. In the following description, the voltage applied across the electrodes of the piezoelectric element 38 in the section in which the voltage of the drive waveform is maintained at a fixed level is referred to as a maintenance voltage Vh.

Figure 7:
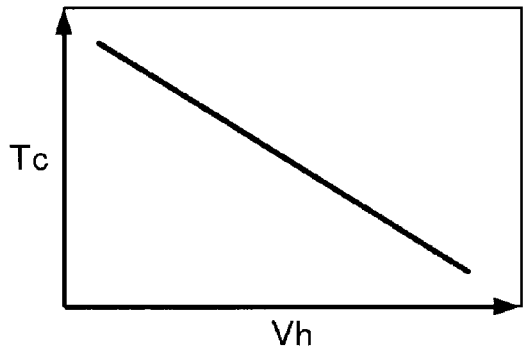
FIG. 7 is a graph illustrating the relationship between a maintenance voltage and a natural vibration period.

FIG. 7 is a graph illustrating a relationship between the maintenance voltage Vh applied to the piezoelectric element 38 and a natural vibration period Tc of the pressure chamber C. The natural vibration period Tc is a natural period of Helmholtz resonance. The period of change in pressure inside the pressure chamber C is dependent on the natural vibration period Tc.

The elastic compliance of the piezoelectric element 38 varies depending on the voltage applied to the piezoelectric element 38, and the natural vibration period Tc of the pressure chamber C is dependent on the maintenance voltage Vh. Specifically, as understood from FIG. 7, as the maintenance voltage Vh increases, the natural vibration period Tc decreases. Thus, the natural vibration period Tc when the voltage in the section Qa2 is supplied to the piezoelectric element 38 is shorter than the natural vibration period Tc when the voltage in the section Qb2 is supplied to the piezoelectric element 38.

It is desired that the period of the drive waveform supplied to the piezoelectric element 38 is determined in accordance with the natural vibration period Tc. Specifically, the period of the drive waveform is determined as, for example, a period approximately half the natural vibration period Tc. As described above, the natural vibration period Tc in the section Qa2 and the natural vibration period Tc in the section Qb2 differ from each other, in the first embodiment, the length of a period T1 of the first drive waveform W1 and the length of a period T2 of the second drive waveform W2 are determined to differ from each other. The period T1 lasts from the start point of the section Qa1 to the end point of the section Qa3. Similarly, the period T2 lasts from the start point of the section Qb1 to the end point of the section Qb3. As illustrated in FIG. 6, the period T1 of the first drive waveform W1 is shorter than the period T2 of the second drive waveform W2. Specifically, a period Ta2 of the section Qa2 of the first drive waveform W1 is shorter than a period Tb2 of the section Qb2 of the second drive waveform W2. The length of the period of the section Qa1 and the length of the period of the section Qb1 are identical to each other; and the length of the period of the section Qa3 and the length of the period of the section Qb3 are identical to each other.

As illustrated in FIG. 6, when a period Ta1 corresponding to half of the section Qa1 of the first drive waveform W1 and a period Ta3 corresponding to half of the section Qa3 are taken into account, the period Ta2 of the section Qa2 of the first drive waveform W1 is determined as a period equal to or greater than the average of the period Ta1 and the period Ta3 (Ta1+Ta3)/2. Similarly, when a period Tb1 corresponding to half of the section Qb1 of the second drive waveform W2 and a period Tb3 corresponding to half of the section Qb3 are taken into account, the period Tb2 of the section Qb2 of the second drive waveform W2 is determined as a period equal to or greater than the average of the period Tb1 and the period Tb3 (Tb1+Tb3)/2.

As a comparative example, a configuration in which the length of the period of the first drive waveform W1 and the length of the period of the second drive waveform W2 are identical to each other is considered. In the comparative example, similarly to the first embodiment, the maintenance voltage Vh in the section Qa2 is higher than the maintenance voltage Vh in the section Qb2. Here, in the comparative example, it is assumed that, in order to achieve target ejection characteristics when the first drive waveform W1 is supplied, the period of the first drive waveform W1 and the period of the second drive waveform W2 are determined based on the natural vibration period Tc when the first drive waveform W1 is supplied. The ejection characteristics includes, for example, the amount of ink for ejection, the speed of ejection of ink, and the direction of ejection. As described above, the natural vibration period Tc varies between the case in which the first drive waveform W1 is supplied and the case in which the second drive waveform W2. Hence, in the comparative example, the target ejection characteristics may not be achieved when the second drive waveform W2 is supplied. Thus, in the comparative example, an error may occur in the ejection characteristics due to the change of the natural vibration period Tc.

By contrast to the comparative example described above, in the first embodiment, the length of the period T1 of the first drive waveform W1 is shorter than the length of the period T2 of the second drive waveform W2. In other words, the period T1 of the first drive waveform W1 is determined in accordance with the natural vibration period Tc when the first drive waveform W1 is supplied and the period T2 of the second drive waveform W2 is determined in accordance with the natural vibration period Tc when the second drive waveform W2 is supplied. Hence, compared to the comparative example, the first embodiment can reduce an error occurring in ejection characteristics due to the change of the natural vibration period Tc.

In the first embodiment, in particular, the period Ta2 of the section Qa2 is determined to be shorter than the period Tb2 of the section Qb2; in other words, the period of a section in which the voltage is maintained is adjusted in accordance with the natural vibration period Tc. Thus, there is an advantage in which the adjustment of the period of the drive waveform in accordance with the natural vibration period Tc is easily accomplished.

Second Embodiment

Hereinafter, a second embodiment is described. It should be noted that, in examples described below, elements having the same functions as those of the first embodiment are denoted by the same reference characters used in the description of the first embodiment and detailed descriptions thereof are omitted as appropriate.

Figure 8:
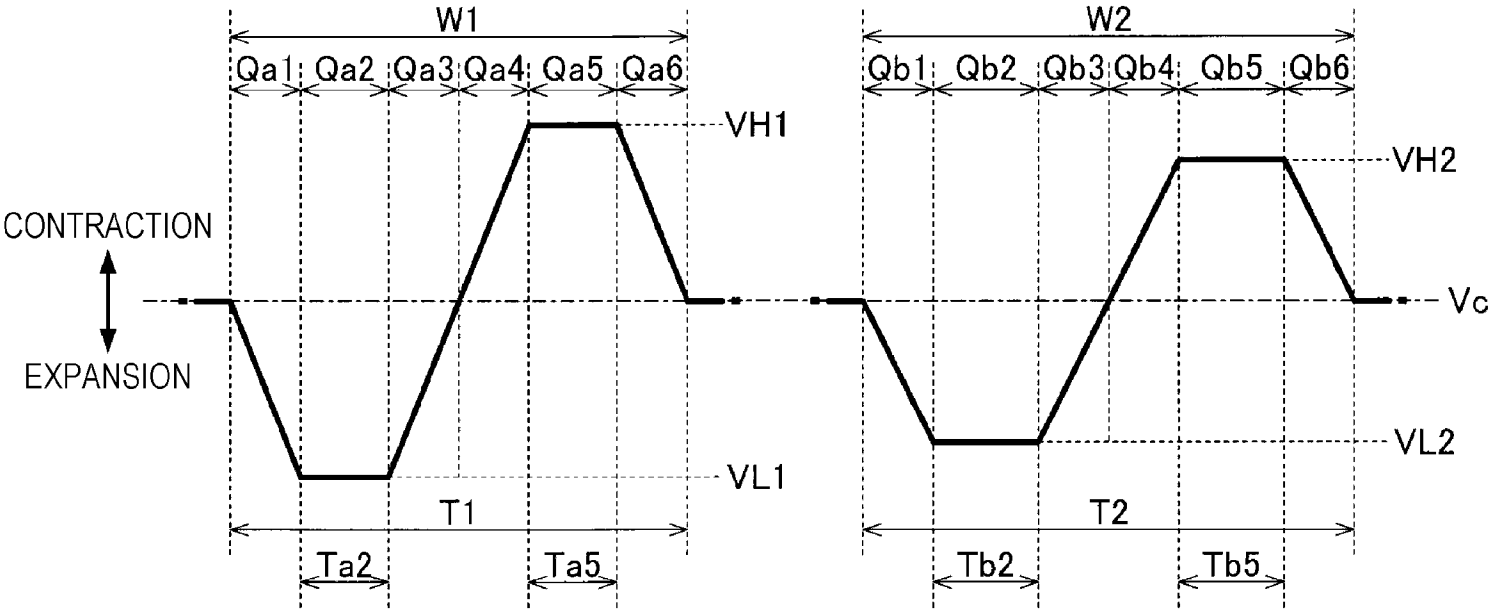
FIG. 8 illustrates drive waveforms according to a second embodiment.

The second embodiment and the first embodiment differ in the shape of the first drive waveform W1 and the shape of the second drive waveform W2. FIG. 8 illustrates the first drive waveform W1 and the second drive waveform W2 according to the second embodiment.

As illustrated in FIG. 8, the first drive waveform W1 includes the section Qa1, the section Qa2, the section Qa3, a section Qa4, a section Qa5, and a section Qa6 in this order to cover from its start point to its end point. The changes in voltage from the section Qa1 to the section Qa3 coincide with those of the first embodiment. In the section Qa4, the voltage increases from the standard value Vc to a voltage value VH1, which is higher than the standard value Vc, as time elapses. Specifically, the voltage continuously increases from the voltage value VL1 to the voltage value VH1 over the sections Qa3 and Qa4. Accordingly, by supplying the voltage in the sections Qa3 and Qa4, the piezoelectric element 38 causes the pressure chamber C to contract. In the section Qa5, the voltage is maintained at the voltage value VH1. In the section Qa6, the voltage decreases from the voltage value VH1 to the standard value Vc as time elapses. Accordingly, by supplying the voltage in the section Qa6, the piezoelectric element 38 causes the pressure chamber C to expand.

The second drive waveform W2 includes the section Qb1, the section Qb2, the section Qb3, a section Qb4, a section Qb5, and a section Qb6 in this order to cover from its start point to its end point. The changes in voltage from the section Qb1 to the section Qb3 coincide with those of the first embodiment. In the section Qb4, the voltage increases from the standard value Vc to a voltage value VH2, which is higher than the standard value Vc, as time elapses. Specifically, the voltage continuously increases from the voltage value VL2 to the voltage value VH2 over the sections Qb3 and Qb4. Accordingly, by supplying the voltage in the section Qb3 and the section Qb4, the piezoelectric element 38 causes the pressure chamber C to contract. In the section Qb5, the voltage is maintained at the voltage value VH2. In the section Qb6, the voltage decreases from the voltage value VH2 to the standard value Vc as time elapses. Accordingly, by supplying the voltage in the section Qb6, the piezoelectric element 38 causes the pressure chamber C to expand.

Similarly to the first embodiment, the voltage value VL1 in the section Qa2 of the first drive waveform W1 is smaller than the voltage value VL2 in the section Qb2 of the second drive waveform W2. The voltage value VH1 in the section Qa5 of the first drive waveform W1 is smaller than the voltage value VH2 in the section Qb5 of the second drive waveform W2. Accordingly, the maintenance voltage Vh applied to the piezoelectric element 38 in the sections Qa2 and Qa5 of the first drive waveform W1 is higher than the maintenance voltage Vh applied to the piezoelectric element 38 in the sections Qb2 and Qb5 of the second drive waveform W2. Therefore, the natural vibration period Tc when the first drive waveform W1 is supplied is shorter than the natural vibration period Tc when the second drive waveform W2 is supplied.

In consideration of the conditions described above, similarly to the first embodiment, the period T1 of the first drive waveform W1 is determined to be shorter than the period T2 of the second drive waveform W2 also in the second embodiment. Specifically, the period Ta2 of the section Qa2 is shorter than the period Tb2 of the section Qb2 and the period Ta5 of the section Qa5 is shorter than a period Tb5 of the section Qb5. As understood from the above description, the second embodiment achieves the same advantage as that of the first embodiment.

Third Embodiment

Figure 9:
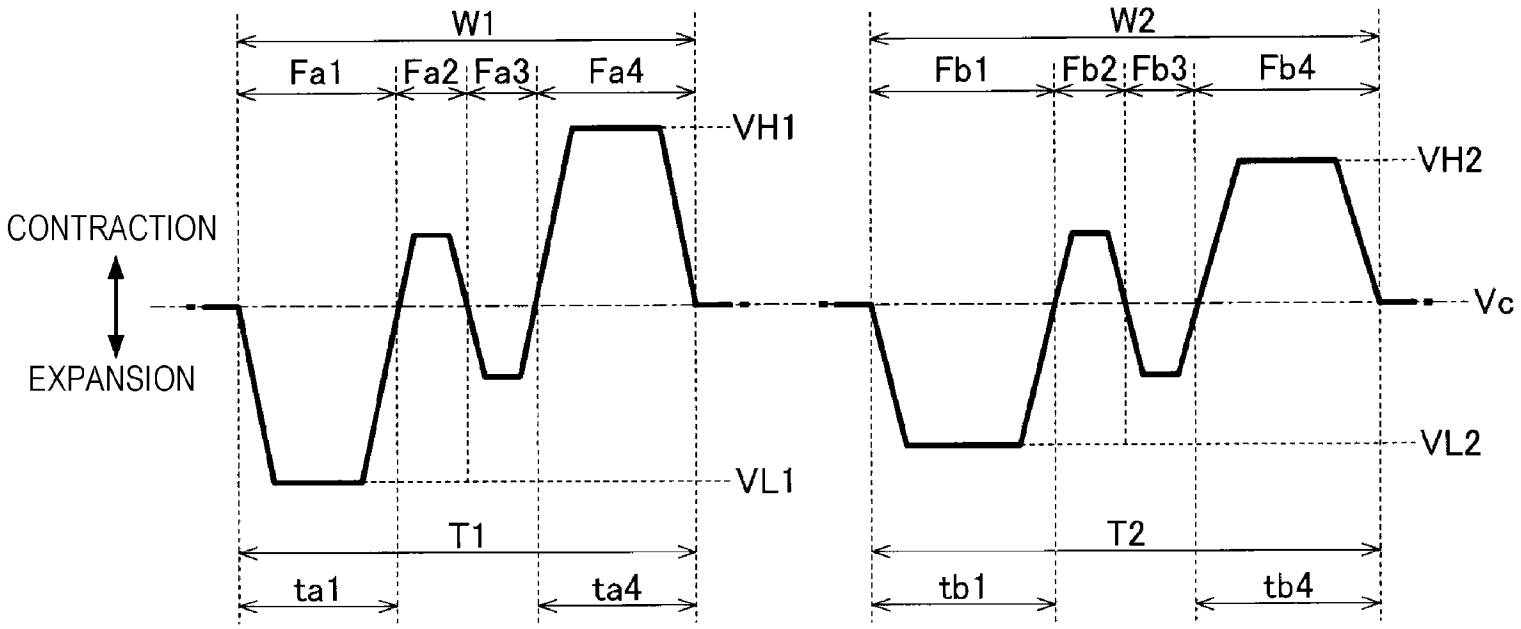
FIG. 9 illustrates drive waveforms according to a third embodiment.

FIG. 9 illustrates the first drive waveform W1 and the second drive waveform W2 according to a third embodiment. As illustrated in FIG. 9, the first drive waveform W1 includes a waveform Fa1, a waveform Fa2, a waveform Fa3, and a waveform Fa4 in this order to cover from its start point to its end point. The shape of the waveform Fa1 is identical to the shape formed from the section Qa1 to the section Qa3 of the first drive waveform W1 according to the second embodiment and the shape of the waveform Fa4 is identical to the shape formed from the section Qa4 to the section Qa6 of the first drive waveform W1 according to the second embodiment. In the waveform Fa2, the voltage increases from the standard value Vc, is then maintained at a given level, and subsequently decreases to the standard value Vc. In the waveform Fa3, the voltage decreases from the standard value Vc, is then maintained at a given level, and subsequently increases to the standard value Vc.

The second drive waveform W2 includes a waveform Fb1, a waveform Fb2, a waveform Fb3, and a waveform Fb4 in this order to cover from its start point to its end point. The shape of the waveform Fb1 is identical to the shape formed from the section Qb1 to the section Qb3 of the second drive waveform W2 according to the second embodiment and the shape of the waveform Fb4 is identical to the shape formed from the section Qb4 to the section Qb6 of the second drive waveform W2 according to the second embodiment. In the waveform Fb2, the voltage increases from the standard value Vc, is then maintained at a given level, and subsequently decreases to the standard value Vc. In the waveform Fb3, the voltage decreases from the standard value Vc, is then maintained at a given level, and subsequently increases to the standard value Vc.

The voltage value VL1 in the waveform Fa1 of the first drive waveform W1 is smaller than the voltage value VL2 in the waveform Fb1 of the second drive waveform W2. The voltage value VH1 in the waveform Fa4 of the first drive waveform W1 is greater than the voltage value VH2 in the waveform Fb4 of the second drive waveform W2. In consideration of the relationship described above, similarly to the second embodiment, the period T1 of the first drive waveform W1 is determined to be shorter than the period T2 of the second drive waveform W2 also in the third embodiment. Specifically, the period Ta1 of the waveform Fa1 of the first drive waveform W1 is shorter than the period tb1 of the waveform Fb1 of the second drive waveform W2. Similarly, the period Ta4 of the waveform Fa4 of the first drive waveform W1 is shorter than the period tb4 of the waveform Fb4 of the second drive waveform W2. Therefore, the third embodiment achieves the same advantage as that of the second embodiment. It should be noted that the shape and the period of the waveform Fa2 of the first drive waveform W1 are identical to those of the waveform Fb2 of the second drive waveform W2 and the shape and the period of the waveform Fa3 of the first drive waveform W1 are identical to those of the waveform Fb3 of the second drive waveform W2.

Fourth Embodiment

Figure 10:
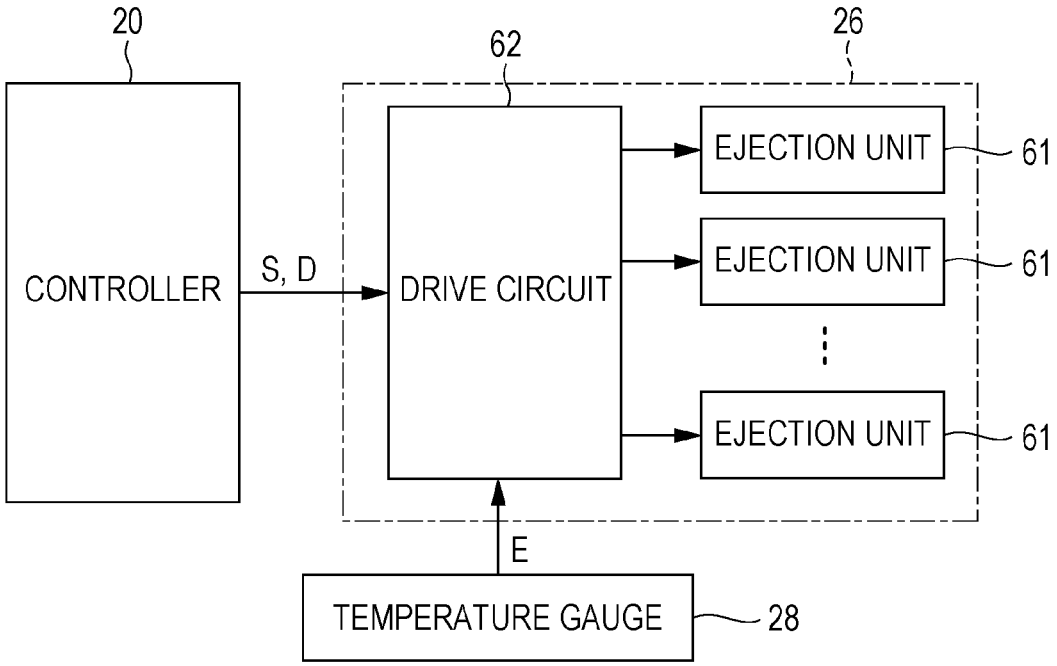
FIG. 10 is a block diagram illustrating an example of a functional configuration of the liquid ejecting apparatus according to a fourth embodiment.

FIG. 10 is a block diagram focusing on the functional configuration of the liquid ejecting apparatus 100 according to a fourth embodiment. As illustrated in FIG. 10, the configuration of the liquid ejecting apparatus 100 according to the fourth embodiment is formed by adding a temperature gauge 28 to the same components as those of the first embodiment. The temperature gauge 28 includes, for example, a known temperature sensor and measures the value of a temperature index E that serves as an index of the temperature of ink introduced in the liquid ejecting head 26. The temperature index E is ideally the temperature of ink per se in the liquid ejecting head 26. However, in practice, the temperature of another element in the liquid ejecting head 26 correlated with the temperature of ink is measured as the temperature index E. For example, the temperature gauge 28 is mounted on the IC chip of the drive circuit 62. As the value of the temperature index E decreases, the ink viscosity increases.

When the ink viscosity increases due to the decrease in the temperature, it is necessary to increase the degree of displacement of the piezoelectric element 38 to eject the target amount of ink from the nozzles N. As a method for increasing the degree of displacement of the piezoelectric element 38, it is considered to increase a voltage magnitude δV of the drive waveform supplied to the piezoelectric element 38. The voltage magnitude δV of the drive waveform denotes a difference between the maximum value and the minimum value of voltage of the drive waveform.

Figure 11:
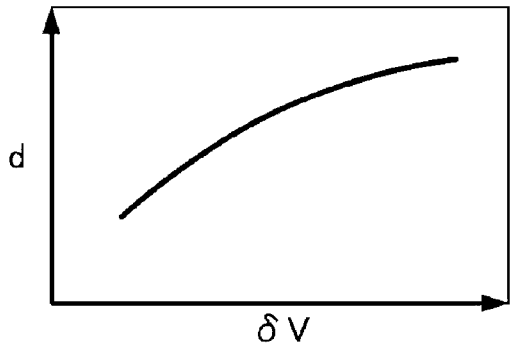
FIG. 11 is a graph illustrating the relationship between the voltage magnitude of a drive waveform and the degree of displacement of the piezoelectric element.

FIG. 11 is a graph illustrating the relationship between the voltage magnitude δV of the drive waveform and the degree d of displacement of the piezoelectric element 38. As understood from FIG. 11, as the voltage magnitude δV increases, the degree d of displacement of the piezoelectric element 38 increases. However, the degree d of displacement varies non-linearly relative to the voltage magnitude δV; and in the area the value of the voltage magnitude δV is relatively large, the increase in the degree d of displacement decreases relative to the increase in the voltage magnitude δV. Thus, the sufficient degree d of displacement of the piezoelectric element 38 may not be achieved by only increasing the voltage magnitude δV.

Figure 12:
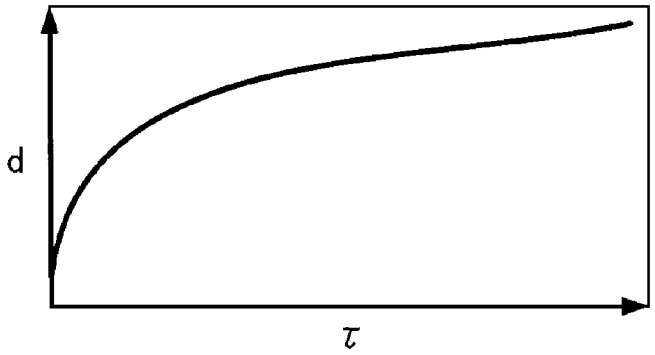
FIG. 12 is a graph illustrating the relationship between the period of a maintenance period and the degree of displacement of the piezoelectric element.

FIG. 12 is a graph illustrating the relationship between a period τ in which the voltage applied to the piezoelectric element 38 is maintained (the period is hereinafter referred to as the maintenance period) and the degree d of displacement of the piezoelectric element 38. As understood from FIG. 12, as the period τ of the maintenance period increases, the degree d of displacement of the piezoelectric element 38 increases. In consideration of the conditions described above, the sufficient degree d of displacement of the piezoelectric element 38 is preferably achieved by the configuration in which, as the temperature index E decreases, the period τ of the maintenance period extends.

Figure 13:
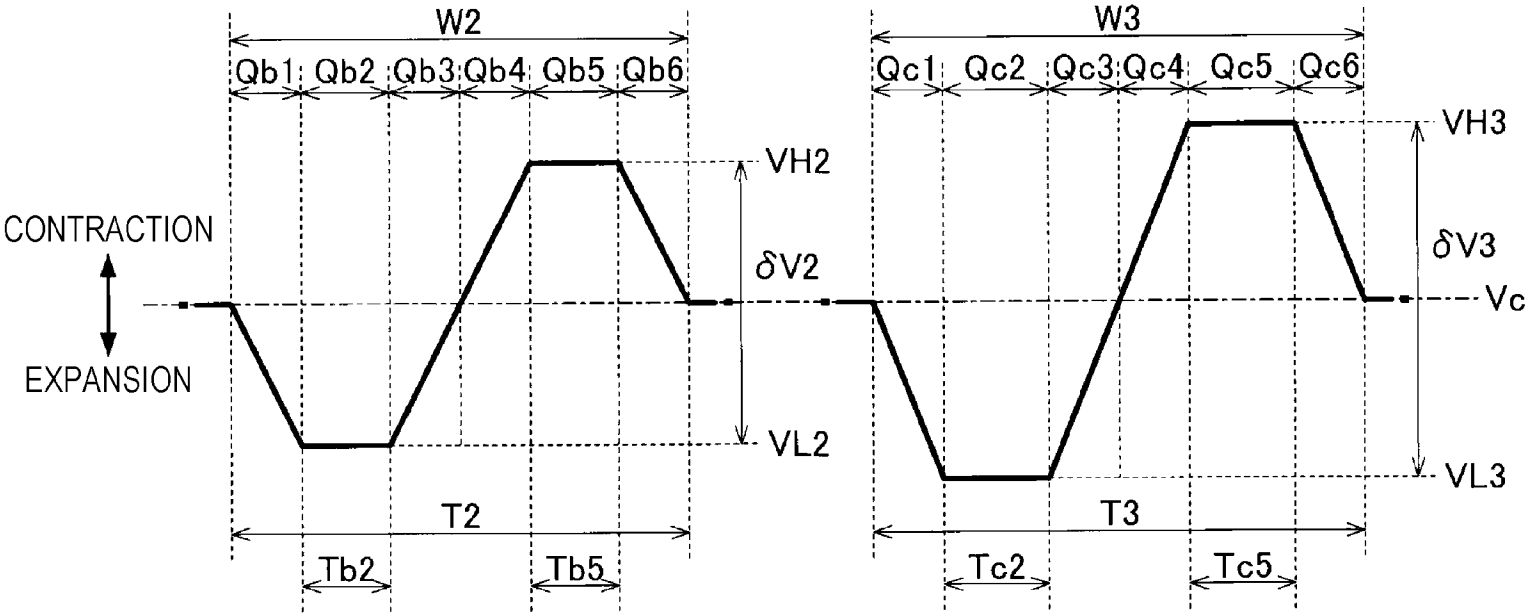
FIG. 13 illustrates drive waveforms according to the fourth embodiment.

FIG. 13 is an explanatory diagram illustrating a signal supplied by the drive circuit 62 to each of the piezoelectric elements 38. The drive signal D supplied by the controller 20 to the drive circuit 62 is a voltage signal having the second drive waveform W2 and a third drive waveform W3. The drive circuit 62 supplies, to particular ones of the piezoelectric elements 38 that are instructed by using the control signal S to eject ink, one of the second drive waveform W2 and the third drive waveform W3 that is selected. A given standard value Vc of voltage is supplied to other particular ones of the piezoelectric elements 38 that are instructed by using the control signal S to not eject ink. The shape of the second drive waveform W2 is the same as that of the first embodiment.

As illustrated in FIG. 13, the third drive waveform W3 includes a section Qc1, a section Qc2, a section Qc3, a section Qc4, a section Qc5, and a section Qc6 in this order to cover from its start point to its end point. In the section Qc1, the voltage decreases from the standard value Vc to a voltage value VL3, which is lower than the standard value Vc, as time elapses. Accordingly, by supplying the voltage in the section Qc1, the piezoelectric element 38 causes the pressure chamber C to expand. In the section Qc2, the voltage is maintained at the voltage value VL3. In the section Qc3, the voltage increases from the voltage value VL3 to the standard value Vc as time elapses. That is to say, the voltage changes in the opposing directions in the sections Qc1 and Qc3. Accordingly, by supplying the voltage in the section Qc3, the piezoelectric element 38 causes the pressure chamber C to contract. The section Qc1 exemplifies a seventh section, the section Qa2 exemplifies an eighth section, and the section Qa3 exemplifies a ninth section.

In the section Qc4, the voltage increases from the standard value Vc to a voltage value VH3, which is higher than the standard value Vc, as time elapses. Specifically, the voltage continuously increases from the voltage value VL3 to the voltage value VH3 over the sections Qc3 and Qc4. Accordingly, by supplying the voltage in the sections Qc3 and Qc4, the piezoelectric element 38 causes the pressure chamber C to contract. In the section Qc5, the voltage is maintained at the voltage value VH3. In the section Qc6, the voltage decreases from the voltage value VH3 to the standard value Vc as time elapses. Accordingly, by supplying the voltage in the section Qc6, the piezoelectric element 38 causes the pressure chamber C to expand.

As illustrated in FIG. 13, a voltage magnitude δV3 of the third drive waveform W3 is greater than the voltage magnitude δV2 of the second drive waveform W2. The voltage magnitude δV3 denotes a difference value between the voltage value VH3 and the voltage value VL3 and the voltage magnitude δV2 denotes a difference value between the voltage value VH2 and the voltage value VL2. As illustrated in FIG. 13, a period T3 of the third drive waveform W3 is longer than the period T2 of the second drive waveform W2. Specifically, a period Tc2 of the section Qc2 of the third drive waveform W3 is longer than the period Tb2 of the section Qb2 of the second drive waveform W2; and a period Tc5 of the section Qc5 of the third drive waveform W3 is longer than the period Tb5 of the section Qb5 of the second drive waveform W2. As understood from the above description, when the temperature of ink does not change, the degree d of displacement of the piezoelectric element 38 to which the third drive waveform W3 is supplied is greater than the degree d of displacement of the piezoelectric element 38 to which the second drive waveform W2 is supplied.

The drive circuit 62 in FIG. 10 supplies to the piezoelectric element 38 one of the second drive waveform W2 and the third drive waveform W3 that is selected in accordance with the temperature index E measured by the temperature gauge 28. Specifically, when the temperature index E exceeds a predetermined threshold Eth, the drive circuit 62 supplies the second drive waveform W2 to the piezoelectric element 38; and conversely, when the temperature index E falls below the threshold Eth, the drive circuit 62 supplies the third drive waveform W3 to the piezoelectric element 38. As described above, as the temperature of ink increases, the value of the temperature index E increases. Thus, when the temperature of ink is relatively high, the drive circuit 62 supplies the second drive waveform W2 to the piezoelectric element 38; and conversely, when the temperature of ink is relatively low, the drive circuit 62 supplies the third drive waveform W3 to the piezoelectric element 38.

As understood from the above description, when it is assumed to use a first temperature and a second temperature lower than the first temperature for ease of description, in the case in which the temperature of ink is the first temperature, the second drive waveform W2 is supplied to the piezoelectric element 38; and in the case in which the temperature of ink is the second temperature, the third drive waveform W3 is supplied to the piezoelectric element 38. In the fourth embodiment, the period T3 of the third drive waveform W3 is longer than the period T2 of the second drive waveform W2. Thus, under the second temperature, the piezoelectric element 38 can be displaced at the degree d of displacement that is a sufficient level. In the fourth embodiment, in particular, the voltage magnitude δV3 of the third drive waveform W3 is greater than the voltage magnitude δV2 of the second drive waveform W2. Accordingly, if the sufficient degree d of displacement of the piezoelectric element 38 cannot be achieved by only rendering the period T3 of the third drive waveform W3 longer than the period T2 of the second drive waveform W2, the sufficient degree d of displacement of the piezoelectric element 38 can be nevertheless achieved in the fourth embodiment.

It should be noted that, while the drive waveforms used in the fourth embodiment is similar to those of the second embodiment, the configuration of the fourth embodiment in which the drive waveform is selected in accordance with the temperature index E may be applied to the configuration in which the drive waveforms described in the first or third embodiment is supplied to the piezoelectric elements 38.

MODIFIED EXAMPLES

The embodiments described above may be changed into various modes. The following descriptions illustrate specific modified examples that can be applied to the embodiments described above. It should be noted that any two or more examples selected from the following description may be combined as appropriate when there is no contradiction.

(1) While in the embodiments described above the period of the maintenance period in which the voltage is maintained varies with respect to each of the different drive waveforms, the period of the section in which the voltage varies may be changed with respect to each of the different drive waveforms. For example, in the first embodiment illustrated in FIG. 6, the period T1 of the first drive waveform W1 may be determined to be shorter than the period T2 of the second drive waveform W2 by determining the section Qa1 of the first drive waveform W1 to be shorter than the section Qb1 of the second drive waveform W2 or determining the section Qa3 of the first drive waveform W1 to be shorter than the section Qb3 of the second drive waveform W2.

(2) While in the embodiments described above one exemplary configuration is used in which the pressure chambers C expands as the voltage of the drive waveform supplied to the piezoelectric element 38 decreases, the correspondence between the high/low voltage of the drive waveform and the expansion/contraction of the pressure chamber C is not limited to the example in the embodiments described above. For example, one configuration may be applied in which the piezoelectric element 38 is displaced to cause the pressure chamber C to contract as the voltage of the drive waveform supplied to the piezoelectric element 38 decreases.

(3) While in the embodiments described above one exemplary configuration is used in which the first electrode 381 is an individual electrode and the second electrode 383 is a common electrode, the first electrode 381 may be a common electrode extending across the multiple piezoelectric elements 38 and the second electrode 383 may be an individual electrode associated with each of the piezoelectric elements 38. Otherwise, both the first electrode 381 and the second electrode 383 may be individual electrodes.

(4) While in the embodiments described above the liquid ejecting apparatus 100 employing a serial printing system in which the carriage 242 equipped with the liquid ejecting head 26 is reciprocated is described as an example, the present disclosure may be applied to a liquid ejecting apparatus employing a line printing system in which the multiple nozzles N are arranged across the entire width of the medium 12.

(5) The liquid ejecting apparatus 100 used as an example in the embodiments described above may be applied to, in addition to a device for only printing, another device such as a facsimile or a copier. Needless to say, the application of the liquid ejecting apparatus according to the present disclosure is not limited to printing. For example, a liquid ejecting apparatus that ejects a color liquid solution can be used as a manufacturing device for producing color filters for liquid crystal display devices. Alternatively, a liquid ejecting apparatus that ejects a liquid solution of conductive material can be used as a manufacturing apparatus for producing wirings for wiring substrates or electrodes.

What is claimed is:

1. A liquid ejecting apparatus comprising:

a vibrating plate constituting a wall of a pressure chamber communicating with a nozzle configured to eject liquid;

a piezoelectric element that is a thin film element and vibrates the vibrating plate; and a drive circuit that supplies multiple drive waveforms including a first drive waveform and a second drive waveform to the piezoelectric element, wherein the first drive waveform includes, in a following order: a first section in which voltage is changed, a second section in which the voltage is maintained, and a third section in which the voltage is changed in a direction opposite to another direction in which the voltage is changed in the first section, the second drive waveform includes, in a following order: a fourth section in which voltage is changed, a fifth section in which the voltage is maintained, and a sixth section in which the voltage is changed in a direction opposite to another direction in which the voltage is changed in the fourth section, a voltage applied to the piezoelectric element in the second section is higher than a voltage applied to the piezoelectric element in the fifth section, and a period of the first drive waveform is shorter than a period of the second drive waveform.

2. The liquid ejecting apparatus according to claim 1, wherein a period of the second section is shorter than a period of the fifth section.

3. The liquid ejecting apparatus according to claim 1, wherein the multiple drive waveforms include a third drive waveform, the third drive waveform includes, in a following order: a seventh section in which voltage is changed, an eighth section in which the voltage is maintained, and a ninth section in which the voltage is changed in a direction opposite to another direction in which the voltage is changed in the seventh section, when a temperature of the liquid is a first temperature, the drive circuit supplies the second drive waveform to the piezoelectric element, when the temperature of the liquid is a second temperature lower than the first temperature, the drive circuit supplies the third drive waveform to the piezoelectric element, and a period of the third drive waveform is longer than the period of the second drive waveform.

4. The liquid ejecting apparatus according to claim 3, wherein a voltage magnitude of the third drive waveform is greater than a voltage magnitude of the second drive waveform.

5. The liquid ejecting apparatus according to claim 1, wherein the piezoelectric element is displaced to increase a volume of the pressure chamber in the first and fourth sections.

* * * * *